US005773769A

United States Patent [19]

Raymond

[11] Patent Number: 5,773,769

[45] Date of Patent: Jun. 30, 1998

[54] TWIN LEVER KEY WITH HORIZONTAL FINGER PADS FOR CODE TRANSMISSION

[76] Inventor: Christopher W. Raymond, 619 Cherry Valley Rd., Princeton, N.J. 08540

[21] Appl. No.: 344,128

[22] Filed: Nov. 23, 1994

[51] Int. Cl.[6] ..... H01H 21/86

[52] U.S. Cl. ..... 178/104; 178/102; 178/109

[58] Field of Search ..... 178/101, 102, 178/103, 104, 105, 106, 107, 108, 109, 110; 116/18, 20; 200/246, 283, 553, 559, 509

[56] References Cited

U.S. PATENT DOCUMENTS

| | | | |
|---|---|---|---|
| 558,617 | 4/1896 | Simons | 178/104 |
| 932,105 | 8/1909 | Bogni | 178/101 |
| 3,160,705 | 12/1964 | Stout | 178/101 |
| 3,757,045 | 9/1973 | Brown | 178/101 |

*Primary Examiner*—Paul Loomis
*Attorney, Agent, or Firm*—Carole Morris

[57] ABSTRACT

A twin lever key with horizontal finger pads for code transmission when used with an electronic iambic keyer in Amateur Radio, the index finger and the middle or third finger of the operator resting on the finger pads, whereby signals are generated by pressing the finger pads of either of the two arms singly or in combination thereof, to produce the dot and dash code signals in iambic predetermined code sequences. There is no lateral wrist or hand action as is typical of the common "paddle key" since the hand is held in the horizontal plane and the key is activated by downward vertical motion from the fingers. The key may be used for code practice, normal continuous wave (cw) operating or contesting.

9 Claims, 1 Drawing Sheet

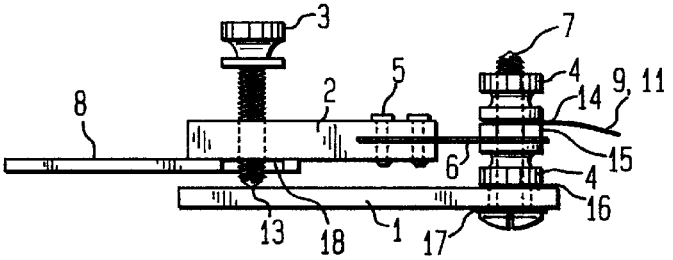
FIG. 1
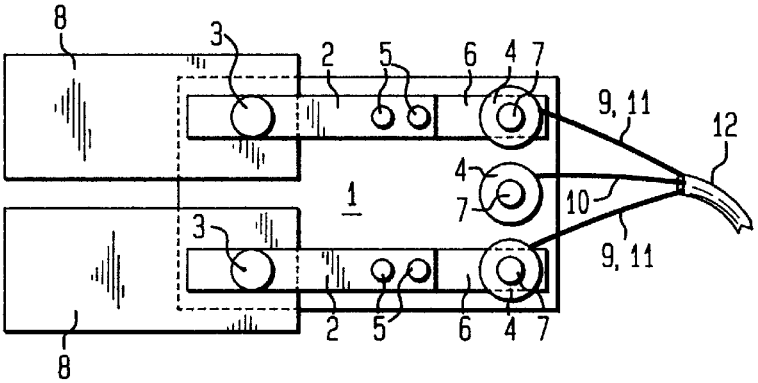
FIG. 2
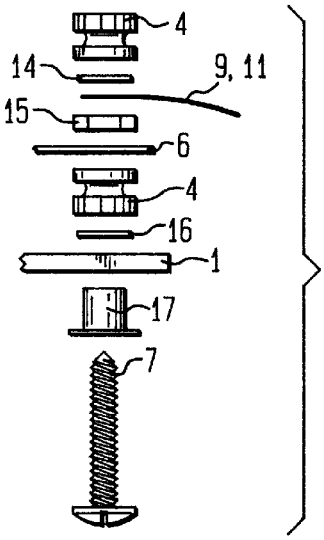
FIG. 4
FIG. 3
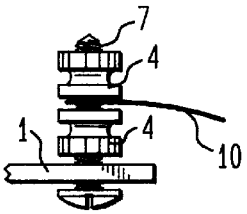
FIG. 6
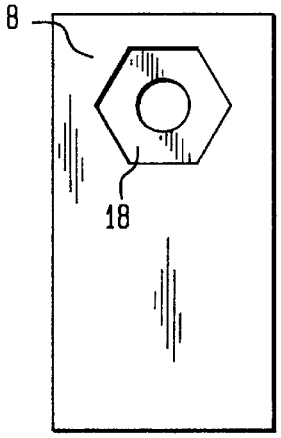
FIG. 5
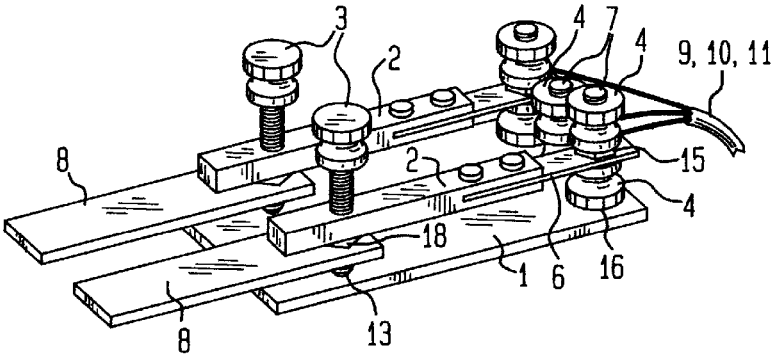

TWIN LEVER KEY WITH HORIZONTAL FINGER PADS FOR CODE TRANSMISSION

BRIEF BACKGROUND OF THE INVENTION

1. Field

This invention relates to a twin lever mechanical radio key used in conjunction with an electronic iambic keyer to generate code signals in Amateur Radio, and more particularly to an improved twin lever radio key.

2. Description of the Prior Art

Existing twin-lever radio key units place the finger pads in the vertical plane, a common configuration referred to as the "paddle", whereby the mechanical key is activated with pressure from the thumb on one lever and the index finger on the other lever. This places the hand in the vertical plane and requires lateral wrist, thumb and finger action to activate the device. This key is used in conjunction with an electronic iambic keying device which electronically generates the dot and dash signals required for continuous wave (cw) coded sequence production when the twin lever key is activated by finger pressure.

Related U.S. Pat. No. 3,757,045 issued Jan. 12, 1972, to William F. Brown, provides a twin-lever configuration whereby the finger action is lateral because the finger pads at the remote end of the lever arms are in the vertical plane, requiring: 1. that the hand be in held in the vertical plane to activate the key and 2., a heavy base to stabilize the unit when activated by pressure from the fingers. Two separate adjustable contact screws are required, as well as an adjustable spring between the levers which biases them to the open position against adjustable stops.

BRIEF SUMMARY

To overcome the problems of the above prior art and to provide a more comfortable and economical twin lever key to be used with an electronic iambic keyer, the twin lever key of this invention employs a unique configuration to keep the hand in the flat or horizontal position, eliminates the need for a heavy metal base and the need for an adjustable spring to bias the contact points to the open position. Each key arm is secured by a flat flexible metal strip to machine screws and related hard ware, which in turn is affixed to but electrically insulated from the base. Separate dot and dash wire from the electronic iambic keyer are secured to the two key arm electrical connections at the remote ends from the finger pads. A single ground connection is provided between the two key arms. The finger pads, at the remote ends from the electrical connections on said levers, are affixed through a thumb screw which also serves as the electrical contact point, thus eliminating the need for a separate contact thumb screw remote from the finger key pad attachment since, in this inventor's configuration, the two are combined. This twin lever key is activated with downward pressure from the index and middle or fourth finger, eliminating the use of the thumb and all lateral hand or wrist action, resulting in an economy of motion and enhancement of comfort. When said levers are pressed downward and released by the fingers on the respective finger pads, the electrical circuit to ground is alternately opened and closed and a predetermined code sequence is generated by the electronic iambic keyer.

Anyone versed in the art of understanding the above specifications will recognize that other modifications and variations may be made without departing from the scope of this invention.

BRIEF DESCRIPTION OF DRAWINGS

1.) A side view of one of the levers, showing the finger pad, thumb screw contact point, flat flexible metal strip and the connecting machine screw and related hardware to the base.

2.) A top view of the key device with horizontal finger pads depicting the overall design and proportional dimensions.

3.) An enlarged side view of the grounded machine screw to the base, wire and thumb nut.

4.) An enlarged side view of the electrically insulated machine screw post from the base, insulating washers, flat metal flexible strip, lock nut wire and related thumb nuts.

5.) A quarter view of the key device showing the relative dimension and proportions.

6.) A top view of the electrically insulated finger key pad with attached hex nut.

DETAILED DESCRIPTION

A twin lever key with horizontal finger pads for code transmission with both levers hinged at their ends by flat flexible metal strips remote from the electrically insulated finger pads, said levers being electrically insulated from the base but having a common but separate ground post, employing thumb screws which serve as the contact point as well as adjusts the bias to the open position, which attach the finger key pads to said lever key arms, and said levers being activated singly or in conjunction with the other by vertical downward pressure from the fingers and the release of said pressure from the index finger and the middle or third finger, which closes and opens the physical and electrical circuit in a predetermined code sequence. The key unit is made up of the following elements: a base (1), key levers (2), thumb screws (3), rivets (4), flat flexible steel strips (6), machine screws (7), finger key pads (8), dot or dash wires (9) and (11), a ground wire (10), wires to the electronic keyer (12), contact points (13), washers (14), hex machine nuts (15), fiber electrical insulators (16), nylon electrical insulator sleeve/washer (17), and hex nuts mounted in insulated finger pads (18).

Each lever (2) is grounded by two insulator washers (17, 16), through a machine screw (7). A thumb nut (4) serves as a spacer to raise the key arm (2) off the base(1). A flat flexible metal strip (6) which is riveted (5) in two places to a slot in the key arm (2), is positioned on top of spacer thumb nut (4) and in turn is anchored by a machine screw hex nut (15). The dot or dash wire (9,11) is then secured around the machine screw (7), by a metal washer (14) and a thumb nut (4).The ground machine screw is anchored to the base (1) by a thumb nut (4). The ground wire (10) is secured with a metal washer (14) and thumb nut (4). Thumb screws (3) are adjusted with the bias in the open position through the hex nut mounted (18) in the insulated key pad (8). When the finger key pads (8) are pressed, either individually or in a predetermined sequence with each other, the flat metal strips flex and the circuits are closed at the contact points (13) of the base (1) and the thumb screw (3) thereby closing the physical and electrical circuit, and with the release of said pressure, generating a predetermined code sequence. Thumb screws (3) are adjusted to a selected open bias position (13) which in turn affects the travel to the base (13) and the degree of tension in the flat flexible metal strip (6).

What is claimed is:

1. A twin lever mechanical key unit with horizontal finger pads for code transmission when used with an electronic iambic keyer, comprising:

a ground base pad, an electrically grounded threaded post with thumb nut attached to said base pad, two key arms, each having physical and electrical contacts and an insulated finger key pad, said key unit operable by downward finger pressure on said insulated finger key pads to close the physical and electrical circuit, opening of the circuit being effected by release of said pressure, in single or in combination of both key arms, thereby generating a predetermined continuous wave code sequence.

2. A twin lever mechanical key unit with horizontal finger pads for code transmission when used with an electronic iambic keyer, comprising:

a ground base pad, two physical and electrical contacts, and two key arms each having an insulated finger key pad, each arm being biased by a flat metal flexible strip, said key unit operable by downward finger pressure on said insulated finger key pads to close the physical and electrical circuit, opening of the circuit being effected by release of said pressure, thereby generating a predetermined continuous wave code sequence.

3. A twin lever mechanical key unit with horizontal finger pads for code transmission comprising:

a ground base pad, two posts mounted on said base pad but insulated therefrom, two key arms each mounted by a flat metal flexible strip on a different one of said posts, two physical and electrical contacts, each mounted on a different one of said key arms, and two insulated finger key pads each mounted on a different one of said key arms, said key unit operable by downward pressure on said insulated finger pads to close the physical and electrical circuit, opening of the circuit being effected by release of said pressure, thereby generating a predetermined continuous wave code sequence.

4. A key unit of claim 3, further comprising a third post mounted on said base pad and in electrical contact therewith.

5. A key unit of claim 3, wherein electrically insulated finger key pads with countersunk hex nuts are attached on the remote end from the flexible metal strip.

6. A key unit of claim 5, wherein said electrically insulated finger key pads are mounted with adjustable threaded thumb screws which serve as the contact point and adjust the bias to the open position.

7. A key unit of claim 2, further comprising a third post mounted on said base pad and in electrical contact therewith.

8. A key unit of claim 2, wherein electrically insulated finger key pads with countersunk hex nuts are attached on the remote end from the flexible metal strip.

9. A key unit of claim 8, wherein said electrically insulated finger key pads are mounted with adjustable threaded thumb screws which serve as the contact point and adjust the bias to the open position.

* * * * *